US006114299A

United States Patent [19]

Hunter et al.

[11] Patent Number: 6,114,299

[45] Date of Patent: Sep. 5, 2000

[54] TEXTILE TREATING COMPOSITIONS COMPRISING N-FUNCTIONAL ORGANOPOLYSILOXANES AND POLYISOBUTYLENE POLYMERS, AND PROCESS OF USING SAME

[75] Inventors: Scott Hunter, Oak Ridge, N.C.; Eugene R. Martin, Onsted, Mich.

[73] Assignee: Wacker Silicones Corporation, Adrian, Mich.

[21] Appl. No.: 08/996,491

[22] Filed: Dec. 23, 1997

[51] Int. Cl.[7] ..... C11D 9/08; C11D 9/06

[52] U.S. Cl. ..... 510/466; 510/475; 510/515; 510/516

[58] Field of Search ..... 510/515, 516, 510/466, 475; 252/8.63, 8.61, 8.62, 8.81–8.86, 8.57, 8.91; 106/2

[56] References Cited

U.S. PATENT DOCUMENTS

| | | | |
|---|---|---|---|
| 4,246,423 | 1/1981 | Martin . | |
| 4,661,577 | 4/1987 | Lane et al. . | |
| 5,039,738 | 8/1991 | Czech | 524/838 |
| 5,073,195 | 12/1991 | Cuthbert et al. | 106/2 |
| 5,077,421 | 12/1991 | Selvig . | |
| 5,205,860 | 4/1993 | Narula et al. | 106/2 |
| 5,209,775 | 5/1993 | Bank et al. | 106/2 |
| 5,300,327 | 4/1994 | Stark-Kasley et al. | 427/387 |
| 5,302,659 | 4/1994 | Bindl et al. . | |
| 5,421,866 | 6/1995 | Stark-Kasley et al. | 106/2 |
| 5,442,010 | 8/1995 | Hauenstein et al. | 524/588 |
| 5,507,960 | 4/1996 | Popa et al. | 252/8.57 |
| 5,514,419 | 5/1996 | Popa et al. | 427/389 |
| 5,629,273 | 5/1997 | Hauenstein . | |

FOREIGN PATENT DOCUMENTS

| | | |
|---|---|---|
| 63-199277 | 8/1988 | Japan . |

*Primary Examiner*—Yogendra Gupta
*Assistant Examiner*—Christine Ingersoll
*Attorney, Agent, or Firm*—Brooks & Kushman P.C.

[57] ABSTRACT

Aqueous textile treating compositions containing both nitrogen-functional organopolysiloxanes and oligomeric polyisobutylene polymers are as effective as conventional textile treating compositions containing only nitrogen-functional organopolysiloxane, and have improved resistance to yellowing, improved washfastness, and are more cost effective. Stable concentrates containing amino-functional organopolysiloxane, polyisobutylene, and a blend-stabilizing surfactant may be used to form aqueous emulsion and microemulsion fabric softener compositions.

31 Claims, No Drawings

TEXTILE TREATING COMPOSITIONS COMPRISING N-FUNCTIONAL ORGANOPOLYSILOXANES AND POLYISOBUTYLENE POLYMERS, AND PROCESS OF USING SAME

TECHNOLOGICAL FIELD

The present invention pertains to textile treating compositions and to a process for the treating of textile substrates with the composition, in particular to improve the softness thereof. More particularly, the present invention pertains to textile softening compositions comprising a nitrogen-functional organopolysiloxane and a polyisobutylene polymer.

DESCRIPTION OF THE RELATED ART

Textile treating agents are utilized to treat fabrics to alter their properties, e.g. to provide a soft hand and feel. For example, emulsions of amino-functional organopolysiloxanes have been used as textile softening agents, as disclosed in U.S. Pat. No. 5,077,421. Such amino-functional silicone fluids may be prepared as described in U.S. Pat. Nos. 4,661,577 and 4,246,423. However, while the amino-functional organopolysiloxanes are efficient and commonly used textile treating agents, they are relatively expensive and, more importantly, are prone to discoloration, particularly yellowing.

The propensity of amino-functional organopolysiloxanes towards thermal yellowing has been recognized, and is discussed, for example, in U.S. Pat. No. 5,302,659, which discloses reacting an amino-functional organopolysiloxane with a carboxylic acid anhydride, in the presence of an emulsifier, in the aqueous phase. The products obtained through this reaction are stated to be acylated, amino-functional organopolysiloxane emulsions which have good storage stability and which are useful as textile finishing agents to provide treated textiles with good soft handle properties and a low tendency to thermal yellowing. However, the additional treatment required to prepare the acylated, amino-functional organopolysiloxanes renders these emulsions yet more expensive than the amino-functional polysiloxanes themselves.

Polybutene polymers are available as liquids and low melting solids which can be dispersed into water to form aqueous emulsions. Due to their low cost, polybutenes, and more specifically, polyisobutylenes, have been suggested for numerous uses as surface coatings, lubricants, etc. In U.S. Pat. No. 5,629,273, stable (non-phase separating) non-aqueous hydraulic fluids containing an organopolysiloxane fluid and a polybutene of identical viscosity were found to produce a hydraulic fluid with lower viscosity and good metal lubricity. In U.S. Pat. No. 5,507,960, emulsions of polyisobutylene and polydimethylsiloxanes are disclosed for treatment of leather, vinyl, and polymer surfaces to renew surface aesthetics, for example to renew automobile dashboards.

It would be desirable to provide compositions comprising emulsions of nitrogen-functional polysiloxanes suitable for use in fabric treating, particularly fabric softening, which exhibit a reduced tendency towards yellowing, which are cost effective as well, and which yet retain the beneficial characteristics of amino- and nitrogen-functional organopolysiloxanes.

SUMMARY OF THE INVENTION

The present invention pertains to fabric treating compositions comprising a nitrogen-functional organopolysiloxane and a polyisobutylene polymer. The inventive compositions can be emulsified just prior to application onto the substrate to be treated; may be prepared as a stable emulsion, particularly a micro-emulsion, which may be used as such or further diluted, as the case may be; or as a concentrate. Fabrics treated with the composition surprisingly exhibit less tendency towards yellowing, particularly after numerous wash cycles, while retaining soft hand.

DESCRIPTION OF THE PREFERRED EMBODIMENTS

The fabric treating compositions of the present invention comprise aqueous emulsions of a nitrogen-functional organopolysiloxane and a polyisobutylene polymer and concentrates suitable for the preparation thereof. More preferably, the emulsions of the subject invention are stable emulsions prepared by emulsifying one or more polyisobutylene polymers and at least one nitrogen-functional organopolysiloxane in the presence of suitable surfactants, cosolvents, and other adjuvants. When so prepared, the emulsions are stable and may be shipped and stored without separation. Preferred emulsions include those in which the polyisobutylene remains dispersed in the formulation, and those in which the nitrogen-functional organopolysiloxane contains pendant amino groups.

Suitable nitrogen-functional polyorganosiloxanes are well known to those skilled in the art and are available from numerous sources. One class of suitable nitrogen-functional organopolysiloxanes contain pendant aminoalkyl groups, and may contain at least one siloxane unit of the general formula:

$$R^1_a Q_b SiO_{\frac{(4-a-b)}{2}} \quad \text{(I)}$$

and other siloxane units of the general formula:

$$R^1_c SiO_{\frac{(4-c)}{2}} \quad \text{(II)}$$

in which each $R^1$ may be the same or different, and represents a monovalent $C_1$ to $C_{18}$ hydrocarbon radical, a monovalent $C_1$ to $C_{18}$ hydrocarbon radical optionally substituted by one or more fluorine atoms; a hydrogen atom, a hydroxyl radical or alkyl glycol radical; or the group represented by $R^2O$ wherein $R^2$ may be the same as $R^1$ above; and Q represents a group of the general formula:

$$—R^3—[NR^3(CH_2)_m]_d NHR^4 \quad \text{(III)}$$

hereinafter termed an "aminoalkyl group", in which $R^3$ represents a divalent $C_1$ to $C_{18}$ hydrocarbon radical, $R^4$ represents hydrogen, a $C_1$ to $C_{18}$ hydrocarbon radical, trialkylsilyl, particularly trimethylsilyl, or a fluorine-substituted $C_1$ to $C_{18}$ hydrocarbon radical, a has a value of 0, 1 or 2, b has a value of 1, 2 or 3, c has a value of 0, 1, 2, or 3, d has a value of 0, 1, 2, 3 or 4, m has a value of 2, 3, 4, 5 or 6 and the sum of a+b is no more than 4.

Non-limiting examples of $C_1$ to $C_{18}$ hydrocarbon radicals include radicals such as methyl, ethyl, n-propyl, iso-propyl, n-butyl, isobutyl, tert-butyl, n-pentyl, iso-pentyl, neo-pentyl or tert-pentyl radicals; hexyl radicals, such as the n-hexyl radical; heptyl radicals, such as the n-heptyl radical; octyl radicals, such as the n-octyl radical; and iso-octyl radicals such as the 2,2,4-trimethylpentyl radical; nonyl radicals, such as the n-nonyl radical; decyl radicals, such as the n-decyl radical; dodecyl radicals, such as the n-dodecyl radical; cycloalkyl radicals, such as cyclopentyl, cyclohexyl or cycloheptyl radicals and methylcyclohexyl radicals; aryl radicals, such as the phenyl radical and the naphthyl radical; alkaryl radicals, such as o-, m- and p-tolyl radicals, xylyl radicals and ethylphenyl radicals; and aralkyl radicals, such as the benzyl radical and the α- and β-phenylethyl radicals. The above hydrocarbon radicals optionally contain an aliphatic double bond. Examples are alkenyl radicals, such as the vinyl, allyl, 5-hexen-1-yl, E-4-hexen-1-yl, Z-4-hexen-1-yl, 2-(3-cyclohexenyl)-ethyl and cyclododeca-4,8-dienyl radical. Preferred radicals containing an aliphatic double bond are the vinyl, allyl and 5-hexen-1-yl radical. Preferably, however, not more than about 1% of the hydrocarbon radicals contain a double bond.

Non-limiting examples of $C_1$ to $C_{18}$ hydrocarbon radicals substituted by fluorine are the 3,3,3-trifluoro-n-propyl radical, the 2,2,2,2',2',2'-hexa-fluoroisopropyl radical, and the heptafluoroisopropyl radical.

Examples of divalent $C_1$ to $C_{18}$ hydrocarbon radicals represented by $R^3$ are saturated straight-chain, branched, or cyclic alkylene radicals, such as the methylene, ethylene, propylene, butylene, pentylene, hexylene, 2-methylpropylene, cyclohexylene and octa-decylene radicals; or unsaturated alkylene or arylene radicals, such as the hexenylene radical and the phenylene radical, in which the n-propylene and the 2-methylpropylene radicals are particularly preferred.

The alkoxy radicals are alkyl radicals described above bonded via an oxygen atom. The examples for the alkyl radicals also apply to the alkoxy radicals. These examples of alkoxy radicals are illustrative and not limiting.

The alkyl glycol radicals represented by $R^1$ preferably have the general formula:

$$—R^3—[O(CHR^4)_d]_nOR^5 \quad (IV)$$

in which $R^3$, $R^4$ and d are the same as above, n has a value of from 1 to 500 and $R^5$ represents a hydrogen atom, a radical $R^4$ or a group of the general formula $$—\overset{O}{\overset{\|}{C}}—R^6,$$

where $R^6$ represents the radical $R^4$, or O—$R^4$.

In the above general formulas (I) to (IV) $R^1$ preferably represents a methyl, phenyl, $C_1$ to $C_3$ alkoxy or hydroxyl radical or a radical of the general formula (IV), $R^3$ preferably represents a divalent $C_2$ to $C_6$ hydrocarbon radical. $R^4$ preferably represents a hydrogen atom or a methyl radical, a preferably represents the value of 0 or 1, b preferably has a value of 1, c preferably has a value of 2 or 3 and d preferably has a value of 1.

Straight-chain nitrogen-functional polydimethylsiloxanes, which optionally have $C_1$ to $C_3$ alkoxy or hydroxyl end groups, or combinations thereof, are particularly preferred. In these polydimethylsiloxanes Q preferably represents a $H_2N(CH_2)_2NH(CH_2)_3$— or $H_2N(CH_2)_2NHCH(CH_3)CH_2$— group.

The ratio of the siloxane units of general formula (I) to the siloxane units of general formula (II) is preferably from 1:10 to 30000, and in particular from 1:20 to 300. The amine content is preferably from 0.001 to 2 meq/g, and in particular from 0.1 to 1.0 meq/g, measured as consumption of 1 N hydrochloric acid in ml/g organopolysiloxane (A) on titration to the neutral point.

It is possible to use only one type of organopolysiloxane (A). However, it is also possible to use a mixture of at least two different types of organopolysiloxane (A).

The organopolysiloxane (A) or a mixture of at least two different types of organopolysiloxane (A) preferably has an average viscosity of from 50 to 100,000 mPa·s, and more particularly from 100 to 10,000 mPa·s at 25° C.

Other nitrogen-functional organopolysiloxanes are suitable as well, as are also derivatives of such polysiloxanes, such as acylated amino-functional polysiloxanes as disclosed in U.S. Pat. No. 5,302,659, which is herein incorporated by reference. Also suitable are the amino-functional polysiloxanes disclosed in U.S. Pat. No. 5,077,421, which is also incorporated herein by reference. Due to the ability to include relatively inexpensive polyisobutylenes in the composition, these higher cost amino-functional organopolysiloxane derivatives may be used without excessive increase in cost.

Preferred amino-functional organopolysiloxanes correspond to the formula:

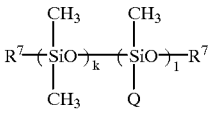

where $R^7$ is a trialkylsilyl group, preferably a trimethylsilyl group, hydrogen, or a monovalent hydrocarbon radical having 1–18 carbon atoms. Each $R^7$ may be the same or different. In the dimethylsiloxy repeating units, k is from about 50 to 1000, preferably from about 500 to 800; and 1 is from about 1.0 to about 10, preferably 1 to about 3; and Q is as defined previously. Most preferably, k and 1 are about 211 and 2.1, respectively, or 275 and 1.5, respectively; and Q is $$H_2N—CH_2CH_2—NH—CH_2CH_2CH_2—$$

In the above formula, each $R^7$ may also be an aminoalkyl group, in which case 1 may be from 0 to about 10. The above formulas represent the average molecule.

The nitrogen-functional organopolysiloxanes just described are eminently suitable for use in the subject invention. Amino-functional organopolysiloxanes having pendant aminoalkyl groups are preferred over organopolysiloxanes having only terminal amino functionality. However, other nitrogen-functional organopolysiloxanes may be used as well. By the term "nitrogen-functional" is meant organopolysiloxanes bearing functional groups containing nitrogen other than those having nitrogen directly bonded to silicon (silazanes). It has been found that in the absence of nitrogen-containing functional groups, organopolysiloxanes will not impart softness to textile fabrics treated there-with. Thus, for example, polydimethylsiloxanes having no nitrogen functionality, and bearing terminal trimethylsiloxy groups such as those taught by U.S. Pat. No. 5,507,960, or bearing alkoxydimethylsiloxy or dimethylsilanol groups are not suitable for use alone as fabric softeners.

The nitrogen-functional organopolysiloxanes may contain aminoalkyl groups, alkyl or aryl-substituted aminoalkyl groups, acylated aminoalkyl groups, amide groups, morpholino groups, pyrollidinyl groups, piperidinyl groups, imide groups, and the like. Further examples of suitable nitrogen-functional organosiloxanes are disclosed in U.S. Pat. Nos. 5,540,952 and 5,663,222, which are herein incorporated by reference. In general, any nitrogen-functional organopolysiloxane useful to impart fabric softness may be used in the present invention.

Most blends of polyisobutylenes and nitrogen-functional organopolysiloxanes are incompatible and phase separate upon standing into distinct liquid phases. The denser organopolysiloxane-rich phase is on the bottom and the less dense polyisobutylene-rich phase is on top. A distinct line of separation is observable. The separation may take several days to form. Centrifuging the composition can accelerate the formation of the separate phases. Separated blends create difficulties for end users. For example, if separation takes place in the storage tank containing the blend, the emulsion made therefrom could contain only one of the components. For instance, in the preparation of aqueous emulsions from concentrate, if the tank emptied from the bottom, the silicone-rich phase would be emulsified first. Emulsions made from the silicone-rich phase and applied to a textile substrate would have more yellowing than an emulsion prepared from a homogeneous, stabilized blend. Subsequent emulsions prepared from the isobutylene-rich phase would not provide adequate textile treating properties.

It has been found that a blend-stabilizing compound can be added to the incompatible concentrates to make the compositions stable even upon centrifugation. A blend-stabilizing compound is soluble in both the polyisobutylene and nitrogen-functional organopolysiloxane components, and prevents the polyisobutylene and nitrogen-functional organopolysiloxanes from separating. These stabilized concentrates may then be emulsified before treating a textile substrate by using suitable surfactants.

The polyisobutylene component of the subject invention is a polyisobutylene polymer, as defined herein, which may be soluble in the amino-functional organopolysiloxane, but is preferably dispersible therewith, within the range of concentration desired to be used; i.e., preferably in a range of polyisobutylene: amino-functional organopolysiloxane of about 95:5 to about 5:95, more preferably 95:5 to 30:70. The polyisobutylenes suitable are oligomeric polymers, copolymers, terpolymers and the like containing greater than 80 mol percent of hydrocarbon residues derived from unsaturated alkenes and/or cycloalkenes, a substantial portion of which are isobutylene residues. Generally, from about 60 mol percent to about 80 mol percent of the polyisobutylene polymers comprise isobutylene residues or the residues of mixtures of isobutylene and butylene. The polyisobutylene polymers may also comprise minor amounts of residues of unsaturated cycloaliphatic hydrocarbons such as cyclohexene, may contain residues of multiply unsaturated hydrocarbons such as butadiene, or other, singly unsaturated alkenes such as ethylene and propylene. Most preferably, greater than 80 mol percent and more preferably greater than 90 mol percent of polymer residues comprise butylene and isobutylene, i.e., the polymer is essentially an isobutylene homopolymer or isobutylene/butylene copolymer.

The polyisobutylene polymers may also contain functional groups such as anhydride groups or dicarboxylic groups such as may be derived by copolymerizing maleic anhydride optionally followed by hydrolysis. Epoxy-functional polyisobutylenes are also suitable. Epoxy-functional polyisobutylene polymers are available as Actipol™ polyisobutylenes from the AMOCO Corporation. Preferred polyisobutylenes are non-functional oligomeric polymers, copolymers, and terpolymers of mixtures of isobutylene, butylene, and butadiene. Such polyisobutylenes are available from the Amoco Corporation under the tradenames Indapol™ and Panalane™ polybutenes. Most preferably, the polyisobutylenes are hydrogenated wholly or partially to remove a substantial amount of residual unreacted double bonds. Such hydrogenated polyisobutylenes are available under the tradename Panalane™ as well. Particularly preferred are the partially hydrogenated polyisobutylenes sold as Panalane™ L-14E or L-14H. However, other polybutenes such as Indapol™ or Panalane™ L-10, L-50, L-65, L-100, H-15, H-25, H-35, H-40, H-50, H-100, H-300, H-1500, and H-1900 are also suitable.

The molecular weights of the polyisobutylene oligomers may preferably range from somewhat lower than about 250 to about 3000 Daltons (Da), preferably from about 300 to 1200 Da. These molecular weights are number average molecular weights. Polyisobutylenes having peak molecular weights in the range of less than 300 Da to about 3000 Da as determined by gel permeation chromatography are also suitable. Polyisobutylenes of higher molecular weights are also suitable, particularly when used as mixtures with lower molecular weight polyisobutylenes. When single polyisobutylene products are used, it is preferred that their number average molecular weights range from less than about 250 to about 2500 Da, more preferably 300 to 1000 Da, and most preferably 300 to 800 Da.

The fabric softening compositions of the subject invention may contain organopolysiloxanes which do not contain nitrogen-functional groups. Such non-nitrogen-functional organopolysiloxanes should be used in a minor amount relative to the total organopolysiloxane component. By "minor amount" as used herein is meant less than 50 percent in a weight basis unless indicated otherwise. Similarly, the term "major amount" indicates 50 percent by weight or more. Examples of non-nitrogen-functional organopolysiloxanes include polydimethylsiloxanes which may be trimethylsilyl capped, or which may bear alkoxy or hydroxyl groups at their termini or along the organopolysiloxane chain. Non-nitrogen-functional organopolysiloxanes are preferably $\alpha,\omega$-dihydroxypolydimethylsiloxanes. Preferably, such non-nitrogen-functional organopolysiloxanes comprise no more than 20 weight percent of the total organopolysiloxane component, more preferably no more than 10 weight percent. Most preferably, only nitrogen-functional organopolysiloxanes are used.

The hydrocarbon component of the fabric treating compositions of the present invention may contain hydrocarbon polymers other than polyisobutylenes as well. Examples include, but are not limited, to dispersible polyethylene, polypropylene, and other polyalkylene polymers and copolymers. By the term "polyalkylene" as used herein is meant polymers whose repeating units comprise one or more of the $C_{2-12}$ lower alkenes or cycloalkenes for example, ethylene, propylene, 1-butene, 2-butene, isobutene, 1-pentene, 1-hexene, 2-hexene, 1-octene, cyclohexene, cyclooctene, cyclododecene, and the like, but contain less than a substantial portion, i.e., less than about 60 mol percent of 1-butene, 2-butene, and isobutene residues, or, in other words, are not polyisobutylenes as these latter polymers have been defined herein. Preferably, these polyalkylene polymers are homopolymers or copolymers of ethylene and propylene. Amounts employed are such that the polyalkylene polymers are stably dispersible in the composition, preferably less than 5 weight percent based on total composition weight, and most preferably about 1 weight percent or less. Polyalkylene copolymers containing dispersing-aiding groups such as carboxylic acid groups derived from acrylic acid and like compounds, optionally neutralized to augment dispersibility, are also useful.

The aqueous fabric treating compositions also generally contain an effective emulsifying amount of one or more surfactants. The emulsifying surfactant may be anionic, cationic, amphoteric, or non-ionic. Suitable surfactants include the various sulfonate and phosphonate surfactants such as alkylbenzenesulfonates and the like. Preferred surfactants are nonionic polyoxyalkylene surfactants such as polyoxyethylated alkylphenols and aliphatic alcohols, for example, polyoxyethylated nonylphenols and polyoxyethylated alkanols such as 1-butanol, 2-ethylhexanol, 1-nonanol, 1-decanol, 1-undecanol, 1-dodecanol, and the like. Such surfactants are readily commercially available. Preferred emulsifying surfactants are the Genapol® surfactants obtained by polyoxyethylating one or a mixture of fatty alcohols, preferably Genapol® UD nonionic surfactants available from Hoechst-Celanese, most preferably Genapol® UD 30 and Genapol® UD 50. The surfactants chosen are those which provide a stable or readily redispersible emulsion, more preferably those which form a microemulsion with dispersed phase droplet size of less than 200 nm, preferably about 100 nm or less.

The aqueous fabric treating compositions also may contain other additives known to those skilled in the art, for example, antistatic agents, microbicides, and the like. Suitable microbicides, which may be present in effective amounts, for example, in the range of 0.01 weight percent to 0.2 weight percent, preferably about 0.05 weight percent, are quaternary nitrogen compounds such as dimethylbenzylammonium chloride, available from the H&S Chemicals Division of Huntington, Huntington, Ind., as FMB 50-5 Quat.

The fabric softening compositions may be supplied in numerous forms tailored to the end use desired and to specific customer requirements. For example, the compositions may be supplied as a concentrate containing only the organopolysiloxane component and the polyisobutylene component in the desired ratio, which may range from (organopolysiloxane:polyisobutylene) 5:95 to about 95:5, preferably 30:70 to 70:30, and more preferably about 40:60 to 60:40. When larger amounts of polyisobutylene are used, the degree of fabric softening may decrease to unacceptable levels. If too little polyisobutylene is used, the increase in resistance to yellowing will not be observed and the cost advantage to use of polyisobutylenes will be lost. Suitable concentrates preferably contain nitrogen-functional organopolysiloxanes other than aminoalkyl terminated organopolysiloxanes. Most preferably, such concentrates contain organopolysiloxanes with terminal, nitrogen-functional, but non-amino-functional groups, or pendant nitrogen-functional groups, most preferably pendant aminoalkyl groups as previously disclosed.

Such concentrates require addition of one or more emulsifying surfactants upon blending into an aqueous softening composition. The emulsifying surfactants or "dispersants" may be added to the siloxane/polyisobutylene concentrate prior to dispersing in water, or may be added to the water. Emulsions are prepared in conventional mixers, e.g., a Cowles mixer such as the Cowles Dispersator™ or Ross VersaMix PVM™ mixer. Other high shear mixers may be used as well. In some cases, easily-emulsifying or self-emulsifying blends may be made by employing suitable surfactants. In such cases, emulsions may be formed by simple, nonhigh shear mixing.

A fabric softener concentrate may be formulated and be emulsified just prior to use. A stable blend of nitrogen-functional organopolysiloxane and polyisobutylene may be made by combining the polysiloxane, polyisobutylene, and a blend-stabilizing compound, and/or suitable solubilizing agent such as D4 cyclic siloxanes or monobutylether cosolvents. The concentrate containing the blend-stabilizing compound is preferably a stable concentrate dispersion which does not separate upon standing for several weeks or longer. In some instances, for example, those compositions containing less than about 30 weight percent nitrogen-functional organopolysiloxane and particularly those compositions containing low molecular weight polyisobutylene oligomers, concentrates which appear to be true solutions may be obtained. The concentrates may also be formulated with desired amounts of microbicides, antistats, UV absorbers, and the like.

A preferred fabric treating concentrate contains 90 weight percent or more of a 65:35 to 35:65 blend of amino-functional organopolysiloxane and polyisobutylene, and a blend-stabilizing amount of a blend stabilizing compound which may be, without limitation, a surfactant, preferably from about 1.5 to 50 weight percent, more preferably about 15 weight percent of Tergitol® TMN3. By the term "blend stabilizing compound and like terms is meant a compound or blend of compounds which are effective to provide a stable dispersion or solution of nitrogen-functional organopolysiloxane and polyisobutylene in substantially non-aqueous form. The "blend stabilizing compound" may also be of assistance in emulsifying the composition in water, but this is not necessary to the function of the blend stabilizing compound. A concentrate may advantageously comprise 40 weight percent or more of the amino-functional organopolysiloxane and polyisobutylene components.

Rather than prepare a concentrate, the ingredients may be emulsified directly in water. The emulsified composition may be supplied as an aqueous dispersion suitable for end use directly for textile treating, or may be supplied as a concentrated aqueous dispersion suitable for dilution with water and optionally additional ingredients, co-solvents, etc., for use in more dilute form. When the end use composition is desired to be a microemulsion, an acid may be added in minor amount. Both inorganic acids as well as organic acids are useful, particularly organic carboxylic acids such as acetic acid, formic acid, and propionic acid. Microemulsion formation is promoted generally with the aid of a most minor portion of acetic acid. Amounts of glacial acetic acid useful range from about 0.01 weight percent to about 2 weight percent or more, preferably from about 0.06 weight percent to about 1.0 weight percent, more preferably about 0.06 weight percent to about 0.10 weight percent, these weight percents relative to the total weight of the aqueous composition. Other acids are useful in equivalent amounts. Most preferably, the aqueous composition contains from about 10 weight percent to about 50 weight percent, more preferably 10 to about 40 weight percent of the organopolysiloxane/hydrocarbon polymer mixture, this mixture containing nitrogen-functional organopolysiloxane and polyisobutylene in a weight ratio of from 5:95 to 95:5, more preferably 30:70 to 70:30, yet more preferably 40:60 to 60:40, and most preferably about 50:50. Suitable aqueous compositions may advantageously contain from 3 weight percent to about 20 weight percent each of the amino-functional organopolysiloxane component and the polyisobutylene component.

The fabric treating composition of the subject invention may be applied to any textile fiber compositions in need thereof. In general, such compositions comprise woven and knitted textile fabrics including but not limited to denims, worsteds, gabardines, jacquards, and other traditional woven materials. However, the fabric treating compositions may also be applied to textile compositions such as polyester fiberfill and like bulk products which require treating. All these are included within the term "textile fabric" as that term is used herein.

Non-limiting examples of aqueous fabric treating compositions may contain the following ingredients:

| Ingredient | Weight Percent |
|---|---|
| Genapol UD 30 | 3.0 |
| Genapol UD 50 | 3.0 |
| Acetic acid, glacial | 0.06–1.0 |
| Amino-functional Organopolysiloxane | 5–18 |
| Polyisobutylene | 5–18 |
| Water | 58–83 |
| Dimethybenzylammonium Chloride | 0.05 |

Water is preferably deionized water prepared by ion exchange treatment or reverse osmosis.

Having generally described this invention, a further understanding can be obtained by reference to certain specific examples which are provided herein for purposes of illustration only and are not intended to be limiting unless otherwise specified.

EXAMPLE 1

A fabric treating concentrate is prepared by stirring together 40 parts Panalane™ L14E; 60 parts of an amino-functional organopolysiloxane available from Wacker Silicones, Adrian, MI under the product designation VP1434E; and 15 parts Tergitol® TMN3 surfactant. The blend is stable and does not separate upon standing or centrifugation.

EXAMPLE 2

An aqueous fabric treating composition is prepared by stirring together the following, in the order indicated:

| Ingredient | Amount (Parts) |
|---|---|
| Genapol UD 30 | 12 |
| Genapol UD 50 | 12 |
| Water | 24 |
| Acetic acid, glacial | 5 |
| Panalane L14E | 30 |
| Amino-functional Organopolysiloxane[1] | 30 |
| Water | 291.5 |

[1]Wacker Silicones VP-1478 organopolysiloxane.

The composition forms a stable emulsion.

Comparative Examples C1 and C2

Microemulsions containing amino-functional organopolysiloxanes but without polyisobutylene are prepared with the following compositions:

| Ingredient | Amount (Parts) C1 | Amount (Parts) C2 |
|---|---|---|
| VP-1478M Amino-functional Organopolysiloxane | 15 | — |
| VP-1434M Amino--functional Organopolysiloxane | — | 17 |
| Genapol UD 50 | 6 | — |
| Genapol XO 60 | — | 9 |
| Genapol XO 30 | — | 1 |

-continued

| Ingredient | Amount (Parts) C1 | Amount (Parts) C2 |
|---|---|---|
| Acetic acid, glacial | 0.31 | 0.11 |
| Benzyltrimethyl-ammonium chloride | 0.05 | — |
| Dodigen 226 | — | 0.05 |
| Water | 78.64 | 72.84 |

Comparative Example C3

An aqueous emulsion of 15 wt. % Panalane L14E polyisobutylene was prepared using 3 wt. % each of Genapol UD 30 and Genapol UD 50 surfactants (UD 30 3%, UD 50 3%).

A series of identical cloth samples of 100% cotton woven material were treated with the aqueous textile treating compositions of the subject invention; with aqueous compositions containing only the aminofunctional organopolysiloxane as the active ingredient; and with aqueous compositions containing only polyisobutylene. Add-on was approximately 1 weight percent solids (based on fabric weight). The softener baths were prepared by diluting 13.3 g of each treating composition to 200 g with water. The samples were presented to a panel of 19 people for hand evaluation. Members of the panel had varying degrees of experience in judging hand. Samples were presented in groups of three, two of the samples in each group being identical. Each member of the panel was asked to pick the two samples he or she judged to be the same in terms of hand, and to select the sample they preferred, again in terms of hand. The data obtained resulted in the following conclusions:

1. The hand of samples treated in accordance with the subject invention are preferable to those treated only with polyisobutylene (i.e., Comparative Example C3)
2. Blends of amino-functional organo-polysiloxane and polyisobutylene in ratios of 70:30 and 30:70 are indistinguishable. A 50:50 blend is distinguishable from the 30:70 and 70:30 blends and is somewhat superior.
3. Most panel members were unable to distinguish between the compositions of the subject invention and a composition containing only VP-1434 amino-functional organopolysiloxane (Comparative Example C2). Those who were able to distinguish the hand of fabrics treated with these compositions preferred the hand of the amino-functional organopolysiloxane/polyisobutylene blend.
4. When VP-1478 amino-functional organopolysiloxane was substituted for VP-1434 (Comparative Example C1), the panel was again, for the most part, incapable of distinguishing between the amino-functional organopolysiloxane/polyisobutylene blend and a composition containing no polyisobutylene.

Yellowing and Washfastness

The subject compositions were compared with similar compositions containing only amino-functional organopolysiloxane. Cured fabric samples treated with the subject composition were noticeably less yellow than the samples treated with amino-functional organopolysiloxane only.

The subject compositions also exhibited surprisingly superior washfastness. Samples treated with compositions by the procedures outlined in the preceding paragraphs were subjected to numerous wash/dry cycles. Following seven wash/dry cycles, the fabrics treated in accordance with the subject invention displayed hand which was imperceivable from the hand of fabrics treated with amino-functional organopolysiloxane only. In addition, the fabrics treated with only amino-functional organopolysiloxane had noticeably greater yellowness after several wash/dry cycles.

In the claims, the use of the adjectives "a" or "an" with respect to a component should be taken to mean "one or more" unless otherwise indicated. By the term "textile treating composition" is meant a composition which is applied to textiles to impart a desirable property or change in property thereof, by leaving a property changing-effective residue thereon. Non-limiting examples of such properties are handle, softness, drape, washfastness, and lubricity. The basic and necessary components of the subject invention may be used to the exclusion of any ingredient not indicated as necessary, whether such ingredient is identified or not.

Having now fully described the invention, it will be apparent to one of ordinary skill in the art that many changes and modifications can be made thereto without departing from the spirit or scope of the invention as set forth herein.

What is claimed is:

1. In a process of treating a textile substrate with a textile treating composition, the improvement comprising contacting said textile substrate with an aqueous textile treating composition comprising, exclusive of water:

a) one or more nitrogen-functional organopolysiloxanes;

b) one or more dispersible polyisobutylene polymers having a number average molecular weight of from about 250 Da or higher;

wherein the weight ratio of a) to b) is from about 5:95 to about 95:5, and wherein said nitrogen-functional organopolysiloxane contains minimally 1 nitrogen-functional organosilicon moiety and 10 moieties of the formula:

$$R'_C(SiO)^{\frac{4-c}{2}}$$

in which each R' independently is a substituted or unsubstituted monovalent $C_{1-18}$ hydrocarbon radical, a hydrogen atom, a hydroxyl radical or alkylglycol radical; or $R^2O$ where $R^2$ may be a substituted or unsubstituted $C_{1-18}$ hydrocarbon radical or a hydrogen radical, and c has a value of 1, 2, or 3.

2. The process of claim 1 wherein at least one of said one or more nitrogen-functional organopolysiloxanes comprises an amino-functional organopolysiloxane.

3. The process of claim 2 wherein said amino-functional organopolysiloxane comprises an organopolysiloxane bearing pendant aminoalkyl groups, and having the formula

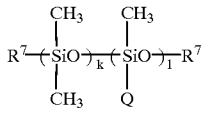

where $R^7$ is a trialkylsilyl group, hydrogen, or a monovalent hydrocarbon radical having 1–18 carbon atoms k is from about 50 to 1000, l is from about 1.0 to 10, and Q is a nitrogen-functional organic group.

4. The process of claim 1 wherein said one or more polyisobutylene polymers have a number average molecular weight of from about 250 Da to 3000 Da.

5. The process of claim 1 wherein said composition further comprises one or more emulsifying surfactants.

6. The process of claim 1 wherein a) and b) are each present in said composition in amounts of from about 3 weight percent to about 20 weight percent based on the total weight of the aqueous composition.

7. The process of claim 1 wherein said textile treating composition further comprises an acid.

8. The process of claim 1 wherein said composition further comprises a biocide, an antistat, a UV absorber, or combinations thereof.

9. A process for treating textile fabric with a textile treating composition, said process comprising:

a) containing said textile fabric with a concentrate comprising:

a)i) a nitrogen-functional organopolysiloxane;

a)ii) a polyisobutylene polymer having a number average molecular weight of about 250 Da or higher; and a)iii) an effective amount of a blend-stabilizing compound which stabilizes a)i and a)ii against separation, wherein the weight ratio of a)i) to a)ii) is from about 5:95 to about 95:5;

b) emulsifying said concentrate in an aqueous composition to form a textile treating emulsion;

c) optionally diluting said textile treating emulsion to form a more dilute emulsion; and d) applying said textile treating emulsion or said more dilute emulsion to textile fabric.

10. The process of claim 9 wherein said concentrate contains an effective amount of one or more emulsifying surfactants different from said blend-stabilizing compound.

11. The process of claim 9 wherein said aqueous composition of (b) contains an effective amount of an emulsifying surfactant.

12. The process of claim 9 wherein said concentrate or said aqueous composition further comprises an acid.

13. The process of claim 12 wherein said acid comprises an organic carboxylic acid.

14. The process of claim 9 wherein said concentrate or said aqueous composition further comprises a biocide, an antistat, a UV absorber, or a combination thereof.

15. The process of claim 9 wherein said nitrogen-functional organopolysiloxane comprises an amino-functional organopolysiloxane.

16. The process of claim 9 wherein the ratio of a)i) to a)ii) is from about 30:70 to 70:30.

17. A concentrate suitable for emulsification in an aqueous composition to provide a textile treating composition, said concentrate comprising a) a nitrogen-functional organopolysiloxane;

b) a polyisobutylene polymer having a number average molecular weight of about 250 Da or higher; and c) an effective amount of a blend-stabilizing compound which stabilizes a) and b) against separation, wherein the weight ratio of a) to b) is from about 5:95 to about 95:5, wherein the sum of components a) and b) together comprise in excess of 40 weight percent of the concentrate.

18. A concentrate suitable for emulsification in an aqueous composition to provide a textile treating composition, said concentrate comprising a) a nitrogen-functional organopolysiloxane;

b) polyisobutylene polymer having a number average molecular weight of about 250 Da or higher; and c) an effective amount of a blend-stabilizing compound which stabilizes a) and b) against separation, wherein the weight ratio of a) to b) is from about 5:95 to about 95:5, further comprising one of more surfactants different from said blend-stabilizing compound, said one or more surfactants effective to aid in dispersing said concentrate in said aqueous composition to form an aqueous emulsion.

19. A concentrate suitable for emulsification in an aqueous composition to provide a textile treating composition, said concentrate comprising a) a nitrogen-functional organopolysiloxane;

b) a polyisobutylene polymer having a number average molecular weight of about 250 Da or higher; and c) an effective amount of a blend-stabilizing compound which stabilizes a) and b) against separation, wherein the weight ratio of a) to b) is from about 5:95 to about 95:5, further comprising a biocide, an antistat, a UV absorber, or a combination thereof.

20. A concentrate suitable for emulsification in an aqueous composition to provide a textile treating composition, said concentrate comprising a) a nitrogen-functional organopolysiloxane;

b) a polyisobutylene polymer having a number average molecular weight of about 250 Da or higher; and c) an effective amount of a blend-stabilizing compound which stabilizes a) and b) against separation, wherein the weight ratio of a) to b) is from about 5:95 to about 95:5, further comprising a minor amount of a non-nitrogen-functional organopolysiloxane.

21. A concentrate suitable for emulsification in an aqueous composition to provide a textile treating composition, said concentrate comprising a) a nitrogen-functional organopolysiloxane;

b) a polyisobutylene polymer having a number average molecular weight of about 250 Da or higher; and c) an effective amount of a blend-stabilizing compound which stabilizes a) and b) against separation, wherein the weight ratio of a) to b) is from about 5:95 to about 95:5, further comprising a polyalkylene polymer or copolymer other than a polyisobutylene polymer.

22. The concentrate of claim 17 wherein the weight ratio of a) to b) is from about 30:70 to 70:30.

23. An aqueous textile treating emulsion or dispersion, comprising a) a nitrogen-functional organopolysiloxane;

b) a polyisobutylene polymer having a number average molecular weight of about 250 Da or higher; and c) an effective amount of an emulsifying surfactant; and d) water;

wherein the weight ratio of a) to b) is from about 5:95 to about 95:5, wherein said effective amount of emulsifying surfactant is effective to from an aqueous emulsion of a) and b), and wherein said nitrogen-functional organopolysiloxane includes a nitrogen-functional organopolysiloxane bearing at least one non-terminal amino functionality.

24. The emulsion or dispersion of claim 23 wherein the number average molecular weight of said polyisobutylene polymer is from about 300 Da to about 3000 Da.

25. The emulsion or dispersion of claim 23 wherein said polyisobutylene polymer is a polyisobutylene polymer soluble in said nitrogen-functional organopolysiloxane.

26. The emulsion or dispersion of claim 23 wherein said polyisobutylene polymer contains polymer moieties derived from isobutylene and one or more of butylene and butadiene monomers.

27. The emulsion or dispersion of claim 23 wherein the weight ratio of a) to b) is from about 40:60 to about 60:40.

28. The emulsion or dispersion of claim 23 further comprising one or more biocides or antistats.

29. A textile treating concentrate suitable for preparing an aqueous textile treating emulsion, said concentrate comprising a) from about 5 to about 95 weight percent based on the sum of a) and b) of one or more nitrogen-functional organopoly-siloxanes, at least one of said one or more nitrogen-functional organopolysiloxanes being an organopolysiloxane bearing at least one non-terminal amino group; and b) from about 95 to about 5 weight percent based on the sum of a) and b) of one or more polyisobutylene oligomers having a molecular weight in excess of about 250 Da.

30. The concentrate of claim 29 wherein at least one of said one or more nitrogen-functional organopolysiloxanes comprises an organopolysiloxane bearing pendant amino-functional groups.

31. A textile treating concentrate suitable for preparing an aqueous textile treating emulsion, said concentrate comprising minimally 90 weight percent of a blend of a) from about 5 to about 95 weight percent based on the weight of a) and b) of one or more nitrogen-functional organopoly-siloxanes; and b) from about 95 to about 5 weight percent based on the weight of a) and b) of one or more polyisobutylene oligomers having a molecular weight in excess of about 250 Da;

wherein said blend of a) and b) is not stable to separation in the absence of a blend-stabilizing compound.

* * * * *

UNITED STATES PATENT AND TRADEMARK OFFICE

CERTIFICATE OF CORRECTION

PATENT NO. : 6,114,299
DATED : September 5, 2000
INVENTOR(S) : Scott Hunter et al.

It is certified that error appears in the above-identified patent and that said Letters Patent is hereby corrected as shown below:

Column 11 Claim 1:
Line 25

$$" R_c^1 (SiO) \frac{4-c}{2} "$$

And insert $$-- R_c^1 (SiO)_{\frac{4-c}{2}} --$$

Column 12, Claim 9:
Line 12, delete "containin" and insert --contacting--.

Signed and Sealed this

Tenth Day of July, 2001

Nicholas P. Godici

*Attest:*

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,114,299
DATED : September 5, 2000
INVENTOR(S) : Sung-Min Cho

It is certified that error appears in the above-identified patent and that said Letters Patent is hereby corrected as shown below:

Column 11, claim 1,
Line 25, "$R_c^1(SiO)\frac{4-c}{2}$" and insert --$R_c^1(SiO)_{\frac{4-c}{2}}$--

Column 12, claim 9,
Line 12, delete "containing" and insert -- contacting --.

Signed and Sealed this

Twenty-fifth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,114,299
DATED : September 5, 2000
INVENTOR(S) : Sung-Min Cho

It is certified that error appears in the above-identified patent and that said Letters Patent is hereby corrected as shown below:

Column 11, claim 1,
Line 25, "$R_c^1(SiO)\frac{4-c}{2}$" and insert --$R_c^1(SiO)_{\frac{4-c}{2}}$--

Column 12, claim 9,
Line 12, delete "containing" and insert -- contacting --.

Signed and Sealed this

Eighth Day of January, 2002

*Attest:*

*Attesting Officer*

JAMES E. ROGAN
*Director of the United States Patent and Trademark Office*